US008356384B1

(12) United States Patent
Ferre et al.

(10) Patent No.: US 8,356,384 B1
(45) Date of Patent: Jan. 22, 2013

(54) HARD DRIVE ASSEMBLY TOOLS FOR EVACUATING PARTICLES

(75) Inventors: Andres G. Ferre, Petaling Jaya (MY); Sie Cheang Phuah, Subang Jaya (MY); Lie Dhani Hastama, Petaling Jaya (MY); Mooi Hoon Lim, Kuala Lumpur (MY); Dean A. Tarrant, San Jose, CA (US)

(73) Assignee: Western Digital Technologies, Inc., Irvine, CA (US)

( * ) Notice: Subject to any disclaimer, the term of this patent is extended or adjusted under 35 U.S.C. 154(b) by 282 days.

(21) Appl. No.: 12/828,094

(22) Filed: Jun. 30, 2010

(51) Int. Cl.
*B08B 3/00* (2006.01)
*A47L 5/38* (2006.01)

(52) U.S. Cl. ..... 15/303; 15/304; 15/345; 134/144; 134/152

(58) Field of Classification Search ..... 15/303, 15/304, 345; 134/137, 144, 151, 152, 902; *B08B 3/00; A47L 5/38*
See application file for complete search history.

(56) References Cited

U.S. PATENT DOCUMENTS

| | | | | |
|---|---|---|---|---|
| 4,801,334 | A * | 1/1989 | Wada et al. | 134/21 |
| 6,779,226 | B2 * | 8/2004 | Hunter et al. | 15/306.1 |
| 6,807,721 | B2 | 10/2004 | Choo et al. | |
| 2009/0229639 | A1 | 9/2009 | Metzner et al. | |

* cited by examiner

*Primary Examiner* — David Redding

(57) ABSTRACT

A clean and purge tool (CAPT) is provided and includes a nest assembly that stows an open hard disk drive (HDD). The nest assembly is rotated from an upward facing position to a downward facing position to dislodge particles from a media clamp of the HDD. The CAPT also includes a cover hingedly attached to the nest assembly and encloses the HDD. The CAPT also includes a spindle clamp assembly (SCA) mounted on the cover and has a vacuum tube configured to encapsulate the media clamp. The SCA includes an air purge nozzle extending into the vacuum tube. The CAPT dislodges particles from the media clamp when pulses of compressed gas are applied to the media clamp by a compressed gas source via the air purge nozzle and evacuates the particles from the vacuum tube when a vacuum is applied to the vacuum tube by a vacuum source.

13 Claims, 8 Drawing Sheets

22a

HARD DRIVE ASSEMBLY TOOLS FOR EVACUATING PARTICLES

FIELD

The present invention generally relates to manufacturing and assembly equipment and, in particular, relates to hard drive assembly tools for evacuating particles.

BACKGROUND

A hard disk drive (HDD) has very small working gaps in which particulate contamination can affect reliability and possibly lead to complete failure of the HDD. For example, the slider and the suspension of a head stack assembly are positioned very close (e.g., tens of nanometers) to the surface of a spinning disk during read and write processes. Loose particles within the HDD may become entrapped between the slider or suspension and the surface of the disk, leading to permanent damage from abrasive wear as the disk is rotated. Thus, during the assembly process of an HDD, it is beneficial to minimize the amount of contaminant particles that the HDD is exposed to. In particular, it is desirable to provide HDD assembly tools that enhance the cleanliness level during the HDD assembly process.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In certain instances, well-known structures and techniques have not been shown in detail so as not to obscure the subject technology.

In assembling a hard disk drive (HDD), a media clamp may be installed at a motor hub of the HDD to secure media to the head disk assembly of the HDD. The media clamp is typically fastened to the motor hub with one or more screws. However, when the one or more screws are driven, by a screw driver, into corresponding threaded holes in the media clamp and/or motor hub, particles may be generated as a result of abrasive contact between the one or more screws and the media clamp, the motor hub, and/or the screw driver. These particles may contaminant other components of the HDD. For example, the particles may spill over to the surface of the media, thereby increasing the risk of failure of the HDD. According to various aspects of the subject technology, a clean and purge (CAP) tool is provided for dislodging and evacuating these particles, particularly from the media clamp.

Figure 1B:
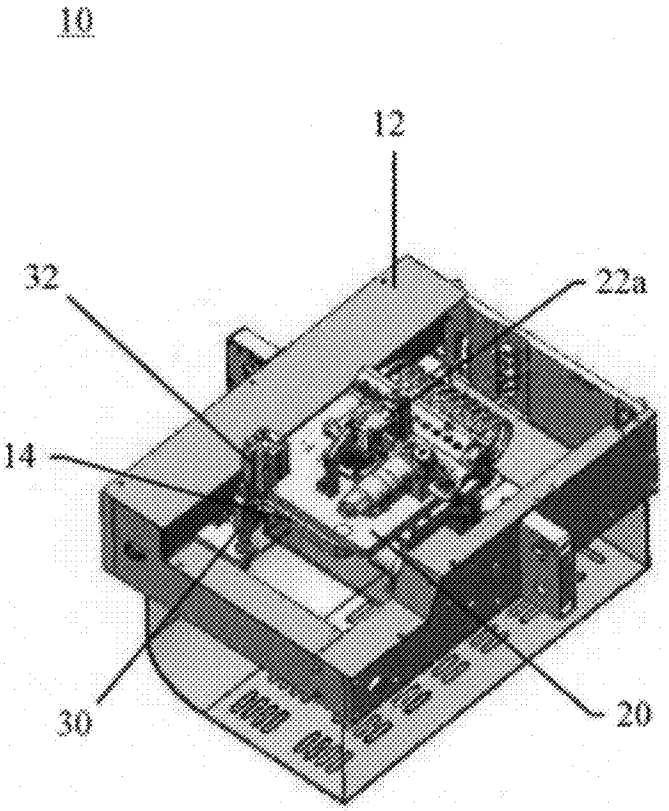
FIGS. 1A and 1B illustrate perspective views of a clean and purge (CAP) tool in accordance with various aspects of the subject technology.
Figure 1A:
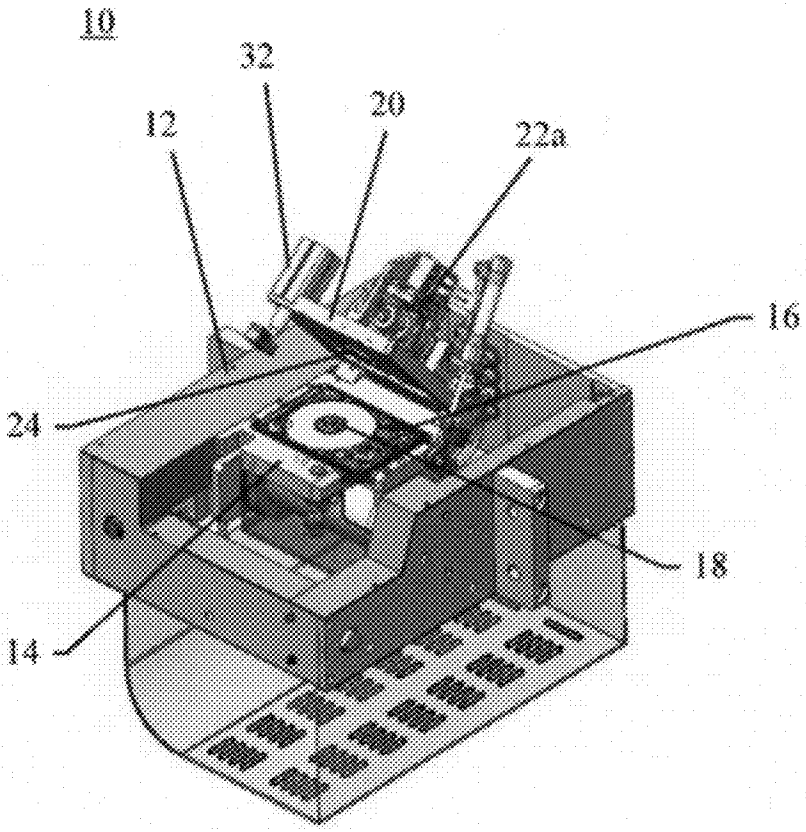

FIGS. 1A and 1B illustrate perspective views of CAP tool 10 in accordance with various aspects of the subject technology. CAP tool 10 is an example of an assembly tool used for dislodging and evacuating particles generated at media clamp 18 of HDD 16. However, CAP tool 10 may also be used for dislodging and evacuating particles from other suitable hard drive components. According to certain aspects, CAP tool 10 comprises main body 12, nest assembly 14, cover 20, and spindle clamp assembly 22*a*.

Nest assembly 14 is configured to stow an open HDD 16, as shown in FIG. 1A. In some aspects, the open HDD 16 does not have a top cover installed, thereby exposing media of HDD 16 on a head disk assembly of HDD 16. In some aspects, media clamp 18 is installed at a motor hub of HDD 16 to secure the media to the head disk assembly. Media clamp 18 may be fastened to the motor hub with a screw, which may result in particles being generated between the screw and media clamp 18, the motor hub, and/or a screw driver used to drive the screw. Therefore, the open HDD 16 may be stowed in nest assembly 14 so that CAP tool 10 may be used for dislodging and evacuating particles generated at media clamp 18 of HDD 16.

In some aspects, cover 20 is hingedly attached to nest assembly 14 and is configured to enclose HDD 16 when HDD 16 is stowed in nest assembly 14. For example, cover 20 may be in an open configuration such that HDD 16 is exposed as shown in FIG. 1A. Cover 20 may also be in a closed configuration such that cover 20 encloses HDD 16 as shown in FIG. 1B. In some aspects, CAP tool 10 further comprises clamp 32 configured to lock cover 20 against nest assembly 14 for enclosing HDD 16 (e.g., to maintain the closed configuration as shown in FIG. 1B).

According to certain aspects, particles at media clamp 18 may be dislodged to facilitate evacuation. In some aspects, nest assembly 14 is rotatably attached to main body 12. Thus, nest assembly 14 is configured to rotate from an upward facing position (as shown in FIGS. 1A and 1B) to a downward facing position to dislodge particles at media clamp 18 of HDD 16 when HDD 16 is stowed in nest assembly 14. In particular, when nest assembly 14 is rotated to the downward facing position, gravity may cause particles at media clamp 18 to be dislodged when HDD 16 is stowed in nest assembly 14.

Figure 2A:
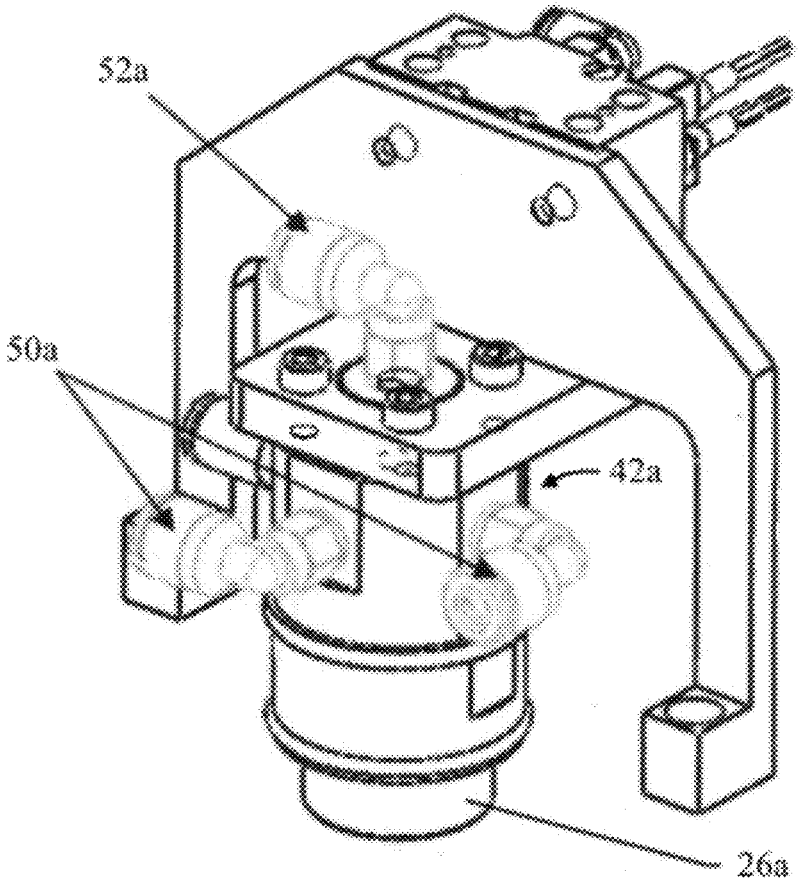
FIGS. 2A, 2B, and 2C illustrate various views of a spindle clamp assembly in accordance with various aspects of the subject technology.
Figure 2B:
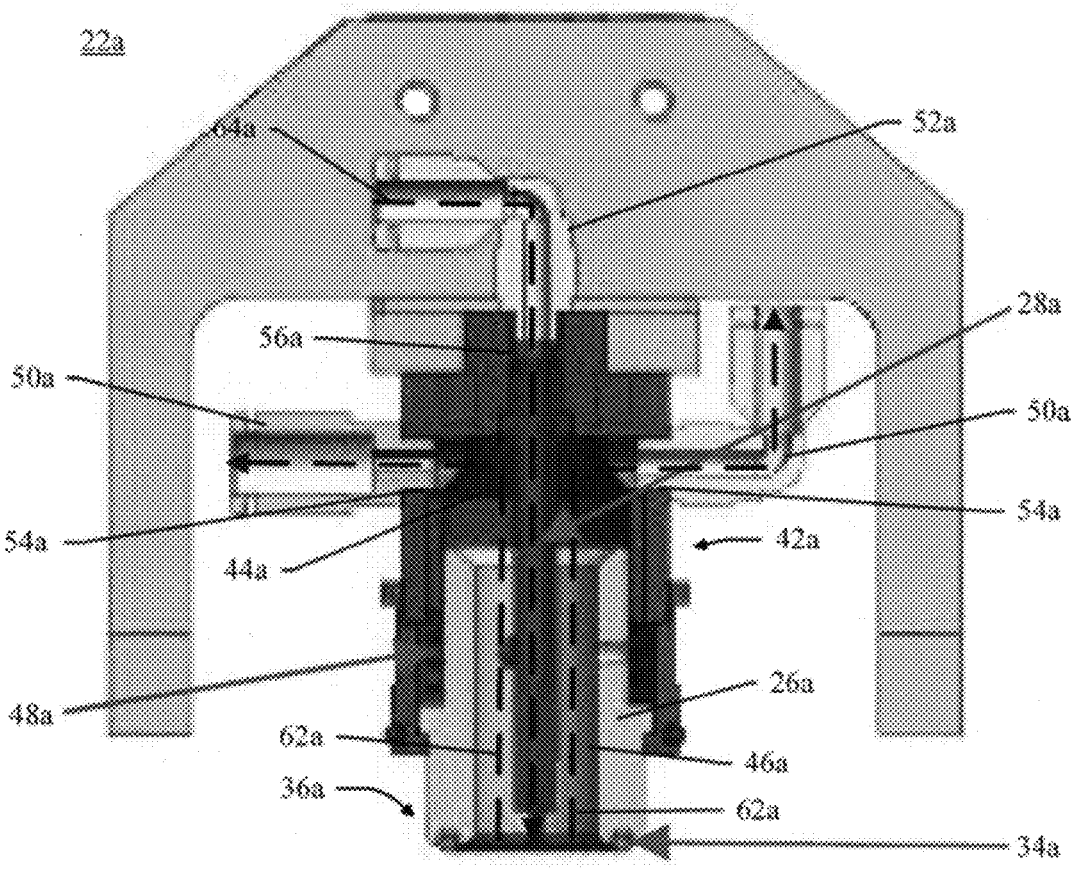
Figure 2C:
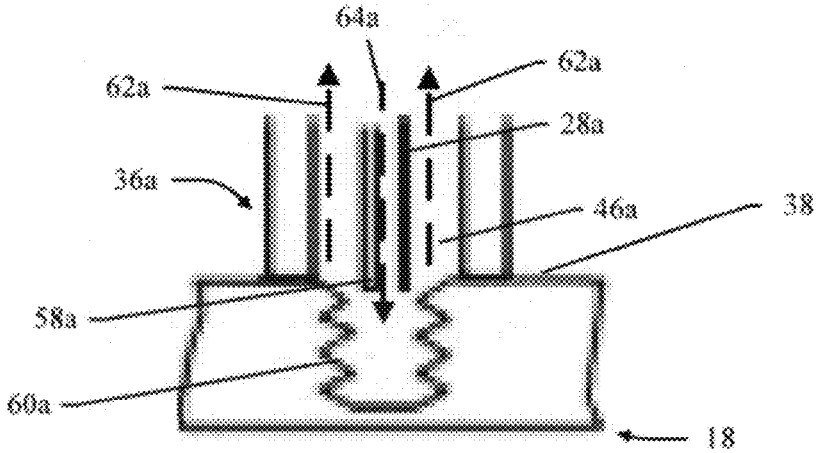

According to certain aspects, spindle clamp assembly 22*a* is mounted on cover 20 and may be used to evacuate the dislodged particles and/or dislodge additional particles at media clamp 14. FIGS. 2A, 2B, and 2C illustrate various views of spindle clamp assembly 22*a* in accordance with various aspects of the subject technology. Spindle clamp assembly 22*a* includes spindle clamp body 42*a* and vacuum tube 26*a*. In some aspects, vacuum tube 26*a* extends through hole 24 defined in cover 20 (e.g., shown in FIG. 1A). Hole 24 may be defined in cover 20 such that when cover 20 is in the closed configuration, hole 24 is positioned over media clamp 18. Thus, when cover 20 encloses HDD 16, vacuum tube 26*a* encapsulates media clamp 18. In some aspects, the encapsulation of media clamp 18 may beneficially ensure that the particles at media clamp 18 do not escape into other parts of HDD 16.

In some aspects, media clamp 18 may be encapsulated using spindle clamp seal 34*a* of spindle clamp assembly 22*a*, as shown in FIG. 2B. Spindle clamp seal 34*a* is attached to distal end 36*a* of vacuum tube 26*a* and is configured to engage surface 38 of media clamp 18 to facilitate the encapsulation of media clamp 18, as shown in FIG. 2C. Spindle clamp seal 34*a* may be made of polyurethane or other suitable material useful for sealing. For example, spindle clamp seal 34*a* may be a polyurethane O-ring attached to a media clamp engaging surface of distal end 36*a*. In some aspects, media clamp 18 comprises threaded hole 60*a* which may receive the screw (not shown) for fastening media clamp 18 to the motor hub of HDD 16. The encapsulation of media clamp 18 may include an area of surface 38 that surrounds threaded hole 60*a*. Accordingly, particles—generated as a result of abrasive contact between the screw and media clamp 18, the motor hub, and/or the screw driver—may be encapsulated within the interior formed between vacuum tube 26*a* and threaded hole 60*a*.

According to certain aspects, compression spring 48*a* (e.g., shown in FIG. 2B) of spindle clamp assembly 22*a* is used to maintain the encapsulation of media clamp 18 when spindle clamp assembly 22*a* engages surface 38 of media clamp 18 via vacuum tube 26*a* and spindle clamp seal 34*a*. Compression spring 48*a* is disposed between spindle clamp body 42*a* and vacuum tube 26*a*. When cover 20 is in the closed configuration and pressed against nest assembly 14, vacuum tube 26*a* is also pressed against media clamp 18. Thus, a force is exerted on vacuum tube 26*a* toward spindle clamp body 42*a*, causing compression spring 48*a* to compress and vacuum tube 26*a* to be displaced with respect to spindle clamp body 42*a*. Compression spring 48*a* is configured to apply a restorative force to at least one of spindle clamp body 42*a* and vacuum tube 26*a* for restoring an original displacement between spindle clamp body 42*a* and vacuum tube 26*a*. Thus, if clamp 32 locks cover 20 against nest assembly 14 (thereby locking spindle clamp assembly 22*a* against media clamp 18), compression spring 48*a* applies the restorative force against vacuum tube 26*a* such that vacuum tube 26*a* and spindle clamp seal 34*a* are pressed against surface 38 to maintain the encapsulation of media clamp 18.

According to various aspects of the subject technology, spindle clamp assembly 22*a* may be used to facilitate evacuation of particles from media clamp 18. As shown in FIG. 2B, vacuum cavity 44*a* is defined within spindle clamp body 42*a*. Spindle clamp body 42*a* is configured to couple vacuum cavity 44*a* to a vacuum source (not shown). In some aspects, spindle clamp assembly 22*a* comprises one or more vacuum fittings 50*a* each mounted to a respective exhaust port 54*a* of vacuum cavity 44*a* and configured to couple the vacuum source to the respective exhaust port 54*a*. In some aspects, vacuum cavity 44*a* is in fluid communication with vacuum channel 46*a* defined in vacuum tube 26*a*. Thus, when the vacuum source applies a vacuum, particles at media clamp 18 are evacuated from media clamp 18 through vacuum channel 46*a*, through vacuum cavity 44*a*, through respective exhaust ports 54*a*, and through respective vacuum fittings 50*a* (e.g., as illustrated by arrows 62*a* in FIGS. 2B and 2C).

In some aspects, the vacuum may be applied, for example, at a flow rate of 25 liters per minute, which is sufficient in strength to evacuate the particles from media clamp 18. However, a higher or lower flow rate may also be used depending on the amount of particles to be evacuated, the size of the particles, the size of media clamp 18, etc. In some aspects, spindle clamp assembly 22*a* comprises a filter configured to be placed between vacuum cavity 44*a* and the vacuum source to capture the particles evacuated from media clamp 18.

According to various aspects of the subject technology, additional methods are provided to dislodge the particles from media clamp 18. For example, as shown in FIG. 2B, spindle clamp assembly 22*a* includes air purge nozzle 28*a* extending into vacuum tube 26*a*. Spindle clamp body 42*a* is configured to couple air purge nozzle 28*a* to a compressed gas source (not shown). In some aspects, spindle clamp assembly 22*a* comprises compressed gas fitting 52*a* mounted to intake port 56*a* of air purge nozzle 28*a* and configured to couple the compressed gas source to intake port 56*a*. In some aspects, exhaust port 58*a* of air purge nozzle 28*a* is oriented toward threaded hole 60*a* of media clamp 18. Thus, the compressed gas source may apply compressed gas to media clamp 18 (e.g., toward threaded hole 60*a* or a screw head of a screw driven into threaded hole 60*a*) via air purge nozzle 28*a* to dislodge particles from media clamp 18. For example, the compressed gas may travel from the compressed gas source through compressed gas fitting 52*a*, through air purge nozzle 28*a*, and through exhaust port 58*a* toward media clamp 18, as illustrated by arrow 64*a* in FIGS. 2B and 2C.

According to various aspects of the subject technology, pulses of compressed gas applied toward media clamp 18 may facilitate effective dislodgment of particles from media clamp 18. For example, applying five pulses of compressed gas to media clamp 18 may effectively dislodge the particles. However, more or less pulses of compressed gas may also be applied depending on the amount of particles to be evacuated, the size of the particles, the size of media clamp 18, etc. In some aspects, each pulse of compressed gas may be applied at a pressure of about one bar per pulse, which may be sufficiently strong to dislodge the particles from media clamp 18. However, a higher or lower pressure per pulse may be applied depending on the amount of particles to be evacuated, the size of the particles, the size of media clamp 18, etc. Once the particles are dislodged, the particles may be evacuated by the vacuum applied by the vacuum source (e.g., as indicated by arrows 62*a* in FIGS. 2B and 2C).

Although FIGS. 1A and 1B illustrate CAP tool 10 with spindle clamp assembly 22*a*, other suitable spindle clamp assemblies with different arrangements may be used. Spindle clamp assembly 22*a* is an example of a spindle clamp assembly having a single air purge nozzle 28*a*. Spindle clamp assembly 22*a*, for example, may be used for HDDs with 2.5 inch form factors, in which media clamps are typically fastened onto motor hubs using a single screw. However, other spindle clamp assemblies having multiple air purge nozzles may be used, for example in situations when multiple screws are used to fasten a media clamp to a motor hub of an HDD. In some aspects, each of the multiple air purge nozzles may be oriented toward a respective one of the multiple screws.

Figure 3A:
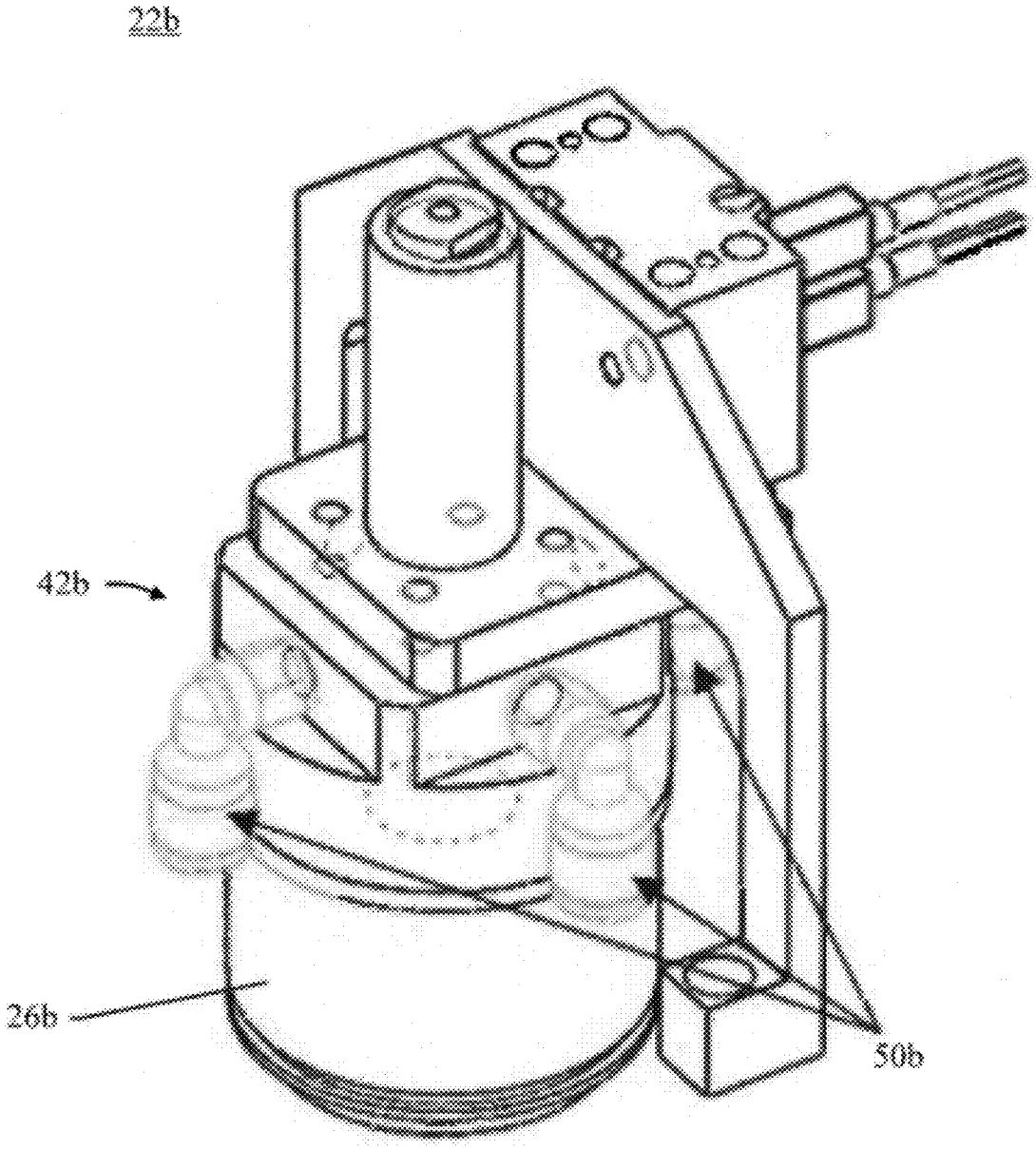
FIGS. 3A, 3B, and 3C illustrate various views of a spindle clamp assembly in accordance with various aspects of the subject technology.
Figure 3B:
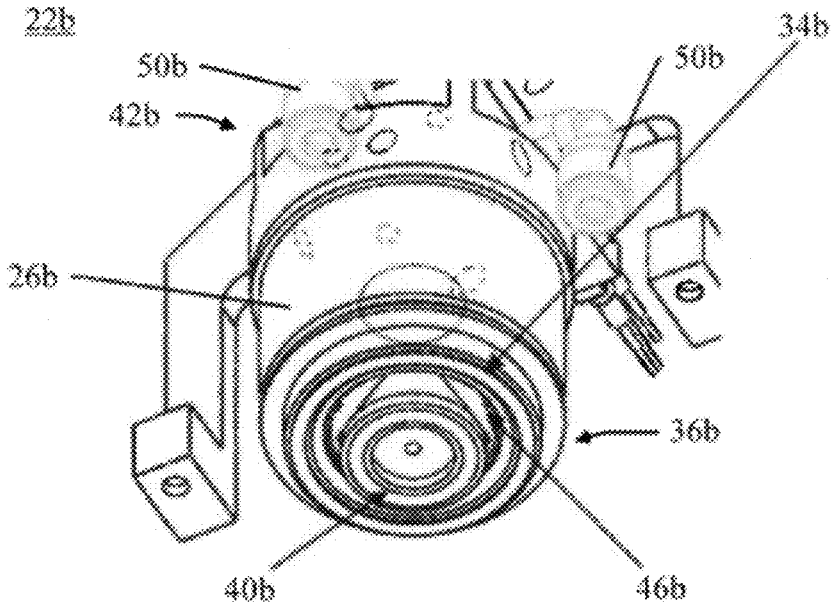
Figure 3C:
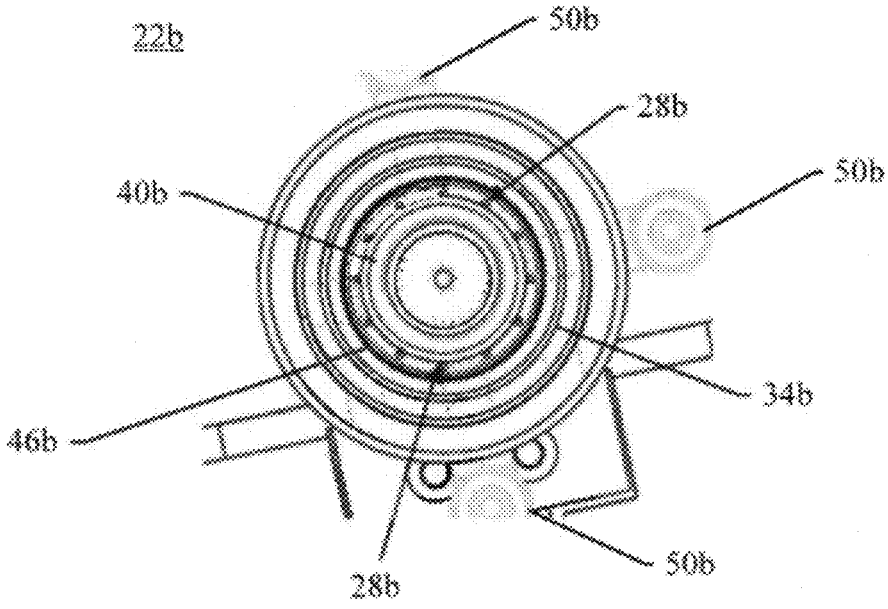

FIGS. 3A, 3B, and 3C illustrate various views of spindle clamp assembly 22*b* in accordance with various aspects of the subject technology. Spindle clamp assembly 22*b* is an example of a spindle clamp assembly having multiple air purge nozzles 28*b*. Spindle clamp assembly 22*b*, for example, may be used for HDDs with 3.5 inch form factors, in which media clamps are typically fastened onto motor hubs using multiple screws. In some aspects, spindle clamp assembly 22*b* may be used with CAP tool 10 instead of spindle clamp assembly 22*a*, particularly when a multi-screw media clamp is used.

Spindle clamp assembly 22*b* comprises similar components as spindle clamp assembly 22*a* and operates in a similar manner as spindle clamp assembly 22*a*. For example, spindle clamp assembly 22*b* comprises spindle clamp body 42*b*, vacuum tube 26*b*, and one or more vacuum fittings 50*b*. A vacuum channel 46*b* is defined in vacuum tube 26*b*, as shown in FIGS. 3B and 3C.

In some aspects, vacuum tube 26*b* may encapsulate the multi-screw media clamp of an HDD to ensure that particles at the multi-screw media clamp do not escape into other parts of the HDD. The multi-screw media clamp may be encapsulated using spindle clamp seal 34*b* and motor hub seal 40*b* of spindle clamp assembly 22*b*, as shown in FIGS. 3B and 3C. Spindle clamp seal 34*b* and motor hub seal 40*b* are attached to distal end 36*b* of vacuum tube 26*b* and are configured to engage a surface of the multi-screw media clamp to facilitate encapsulation of the multi-screw media clamp. Spindle clamp seal 34*b* and/or motor hub seal 40*b* may be made of polyurethane or other suitable material useful for sealing. For example, spindle clamp seal 34*a* and motor hub seal 40*b* may each be a polyurethane O-ring attached to a media clamp engaging surface of distal end 36*b*. Thus, the multi-screw media clamp is encapsulated at the surface of the multi-screw media clamp between the areas where spindle clamp seal 34*b* and motor hub seal 40*b* engage the multi-screw media clamp.

In some aspects, the encapsulated surface of the multi-screw media clamp includes a screw area on which the multiple screws are used to fasten the multi-screw media clamp to the motor hub. In some aspects, vacuum channel 46*b* is in fluid communication with the encapsulated surface to facilitate evacuation of particles from the screw area when spindle clamp assembly 22*b* is engaged to the multi-screw media clamp. The particles are evacuated in a manner similar to the evacuation of the particles with respect to spindle clamp assembly 22*a*.

As shown in FIG. 3C, spindle clamp assembly 22*b* includes multiple air purge nozzles 28*b* extending into vacuum tube 26*b*. The multiple air purge nozzles 28*b* may be oriented toward the screw area of the multi-screw media clamp. Pulses of compressed gas may be supplied through the multiple air purge nozzles 28*b* to dislodge particles from the screw area. The particles are dislodged in a manner similar to the dislodgment of the particles with respect to spindle clamp assembly 22*a*, except that multiple air purge nozzles 28*b* are used instead of a single air purge nozzle 28*a*. The dislodged particles from the multi-screw media clamp may then be evacuated through vacuum channel 46*b*.

Figure 4:
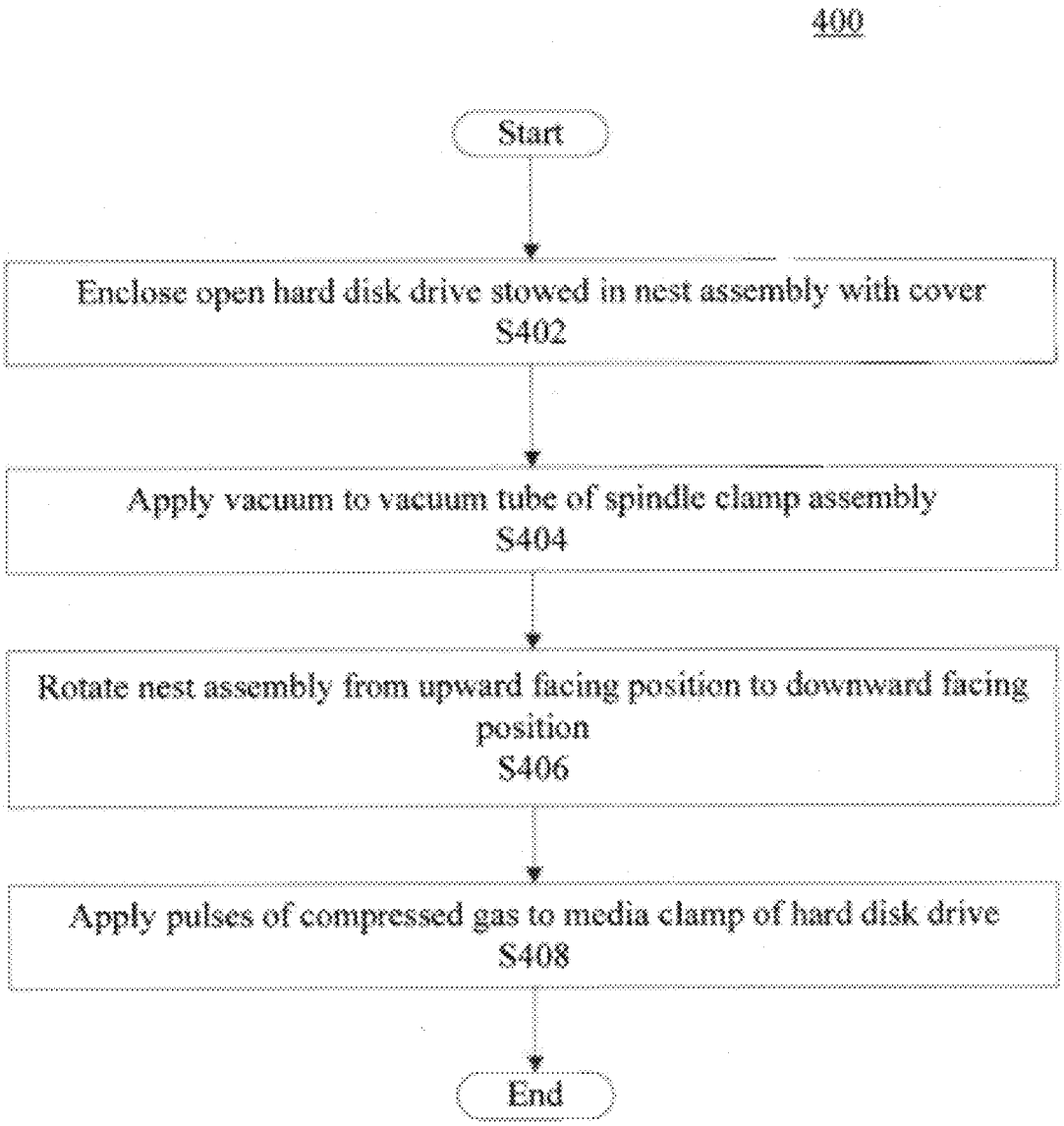
FIG. 4 illustrates an example of a method for evacuating particles from a media clamp of an HDD in accordance with various aspects of the subject technology.
Figure 5A:
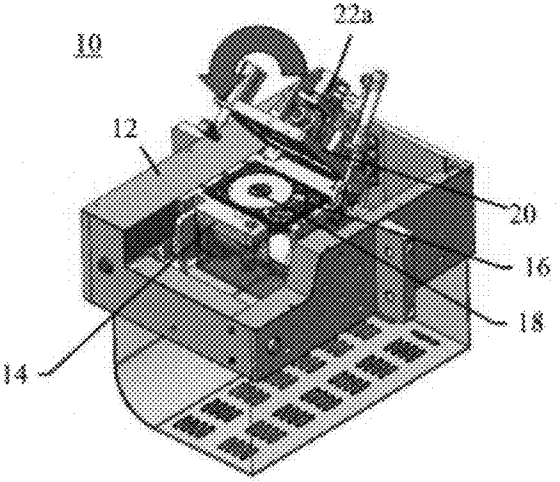
FIGS. 5A, 5B, 5C, 5D, 5E, and 5F illustrate perspective views of a CAP tool in various stages of its operation in accordance with various aspects of the subject technology.

FIG. 4 illustrates an example of method 400 for evacuating particles from a media clamp of an HDD in accordance with various aspects of the subject technology. In some aspects, CAP tool 100 is used to implement method 400. In an initialization process at the "Start" of method 400, an operator of CAP tool 100 may place open HDD 16 having media clamp 18 onto nest assembly 14, as shown in FIG. 5A. Thus, method 400 may be implemented to evacuate particles from media clamp 18.

Figure 5B:
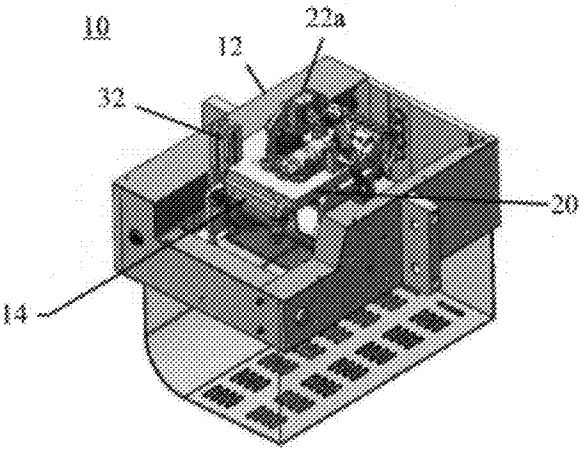

Referring to step S402, cover 20 may be placed in the closed configuration to enclose HDD 16, as shown in FIG. 5B. In some aspects, clamp 32 is used to lock cover 20 against nest assembly 14 for enclosing HDD 16. Because spindle clamp assembly 22*a* is mounted on cover 20, vacuum tube 26*a* extends through hole 24 defined in cover 20 and encapsulates media clamp 18.

Figure 5C:
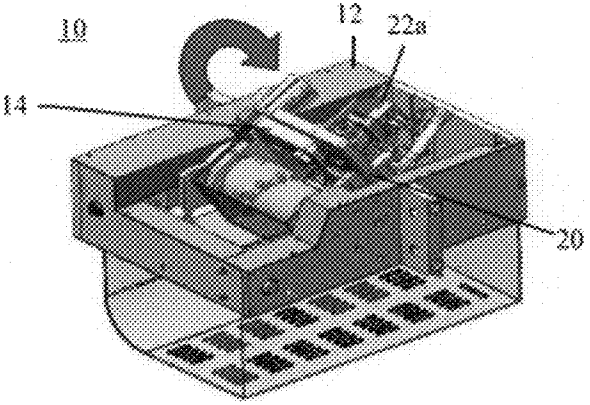
Figure 5D:
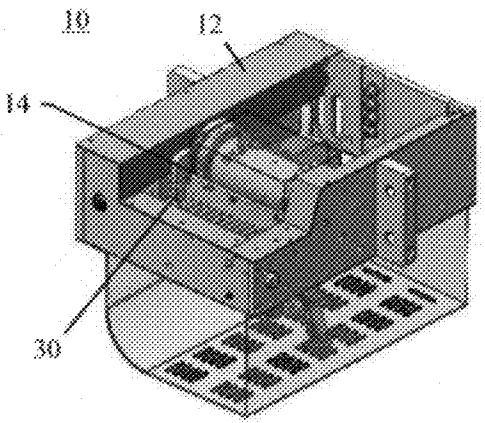

Referring to step S404, the vacuum is applied by the vacuum source, thereby creating a vacuum through the path shown by arrows 62*a*, as shown in FIGS. 2B and 2C. Referring to step S406, nest assembly 14 is rotated from the upward facing position to the downward facing position, as shown progressively from FIG. 5B (e.g. nest assembly 14 is in the upward facing position) to FIG. 5C (e.g., nest assembly 14 is in an intermediate position) and to FIG. 5D (e.g., nest assembly 14 is in the downward facing position). In some aspects, nest assembly 14 is configured to rotate up to 180 degrees from the upward facing position to the downward facing position. In some aspects, CAP tool 10 comprises nest stopper 30 attached to main body 12 and configured to prevent rotation of nest assembly 14 beyond the 180 degree rotation from the upward facing position to the downward facing position, as shown in FIG. 5D. This may allow nest assembly 14 to remain at the downward facing position, thereby allowing gravity to dislodge the particles from media clamp 18.

Referring to step S408, pulses of compressed gas may be applied to media clamp 18 via air purge nozzle 28*a* to dislodge additional particles from media clamp 18. In some aspects, five pulses of compressed gas may be applied to media clamp 18 to effectively dislodge particles from media clamp 18.

In some aspects, step S404 is implemented while step S406 and/or step S408 is implemented so that the vacuum may immediately evacuate the particles as the particles are dislodged from media clamp 18. In some aspects, step S404 may be implemented after S406 and/or step S408. For example, nest assembly 14 may be rotated from the upward facing position to the downward position to dislodge particles from media clamp 18. The vacuum may be applied afterwards to evacuate the dislodged particles from media clamp 18. In another example, pulses of compressed gas may be applied to media clamp 18 to dislodge particles from media clamp 18. The vacuum may be applied afterwards to evacuate these particles. Steps S404, S406, and S408 are not limited to the specific order as shown in FIG. 4, but may be implemented in other orders suitable to dislodge and evacuate particles from media clamp 18.

Figure 5F:
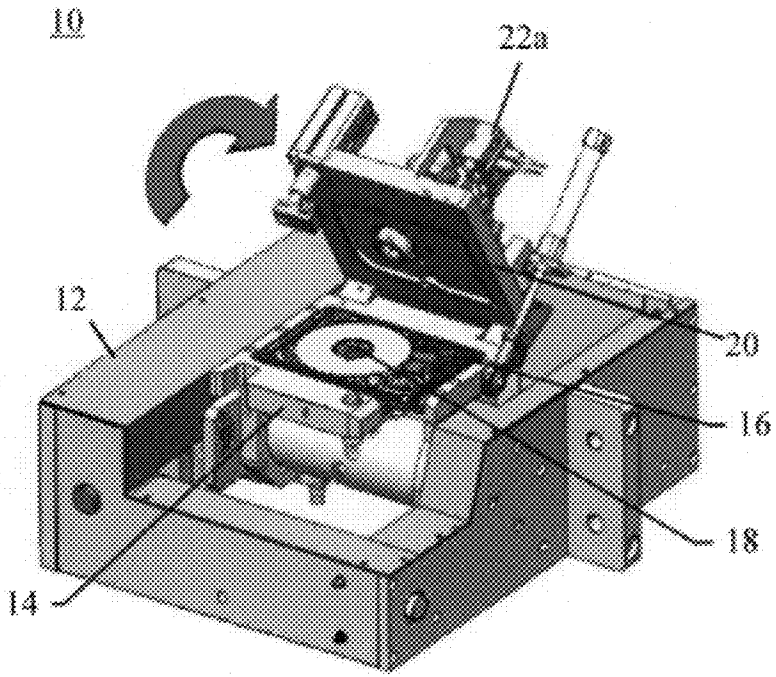
Figure 5E:
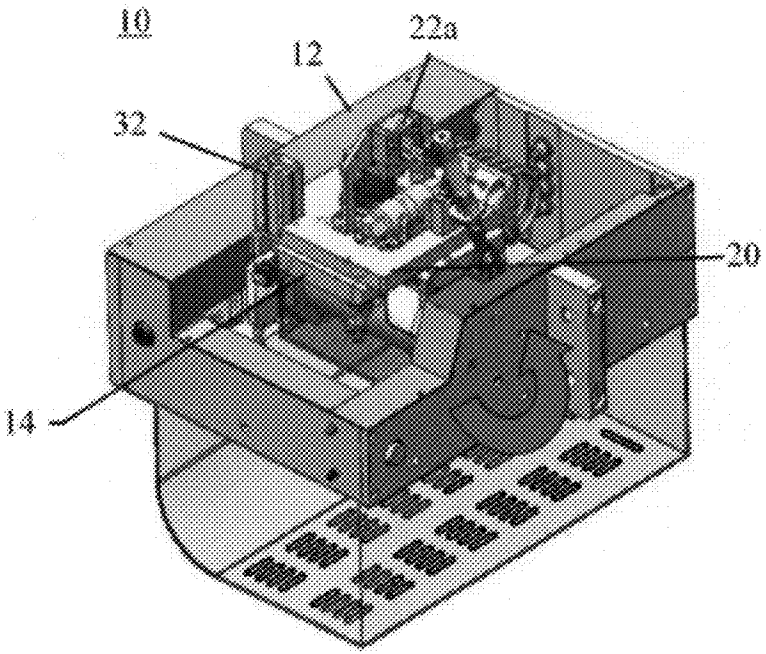

At the "End" of method 400, nest assembly 14 is rotated back to the upward facing position, as shown in FIG. 5E. In some aspects, the vacuum is applied until nest assembly 14 is rotated back to the upward facing position. This may ensure that if any particles are dislodged from media clamp 18 during the rotation of nest assembly 14 back to the upward facing position, the particles may be evacuated by the vacuum. Once the nest assembly is rotated back to the upward facing position, the vacuum may be shut off and cover 20 may be opened to expose HDD 16, as shown in FIG. 5F, thereby completing method 400.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A clean and purge tool comprising:

a main body;

a nest assembly rotatably attached to the main body and configured to stow an open hard disk drive, the nest assembly configured to rotate from an upward facing position to a downward facing position to dislodge particles from a media clamp of the hard disk drive when the hard disk drive is stowed in the nest assembly;

a cover hingedly attached to the nest assembly and configured to enclose the hard disk drive when the hard disk drive is stowed in the nest assembly; and a spindle clamp assembly mounted on the cover and having a vacuum tube extending through a hole in the cover, the vacuum tube configured to encapsulate the media clamp when the cover encloses the hard disk drive, the spindle clamp assembly having an air purge nozzle extending into the vacuum tube, wherein the clean and purge tool is configured to dislodge particles from the media clamp when pulses of compressed gas are applied to the media clamp by a compressed gas source via the air purge nozzle and to evacuate the particles from the vacuum tube when a vacuum is applied to the vacuum tube by a vacuum source.

2. The clean and purge tool of claim 1, wherein the nest assembly is configured to rotate up to 180 degrees from the upward facing position to the downward facing position.

3. The clean and purge tool of claim 1, further comprising a nest stopper attached to the main body and configured to prevent rotation of the nest assembly beyond a 180 degree rotation from the upward facing position to the downward facing position.

4. The clean and purge tool of claim 1, further comprising a clamp configured to lock the cover against the nest assembly for enclosing the hard disk drive.

5. The clean and purge tool of claim 1, wherein the spindle clamp assembly comprises a spindle clamp seal attached to a distal end of the vacuum tube and configured to engage an outer diameter of a surface of the media clamp to facilitate encapsulation, by the vacuum tube, of the media clamp.

6. The clean and purge tool of claim 1, wherein the spindle clamp assembly comprises:

a spindle clamp seal attached to a distal end of the vacuum tube and configured to engage an outer diameter of a surface of the media clamp; and a motor hub seal attached to the distal end of the vacuum tube and configured to engage an inner diameter of the surface of the media clamp, wherein the engagement of the outer diameter and the engagement of the inner diameter facilitates encapsulation, by the vacuum tube, of the media clamp at the surface of the media clamp between the outer diameter and the inner diameter.

7. The clean and purge tool of claim 1, wherein the spindle clamp assembly comprises a spindle clamp body attached to the cover and having a vacuum cavity defined therein, the spindle clamp body configured to couple the vacuum cavity to the vacuum source and to couple the air purge nozzle to the compressed gas source.

8. The clean and purge tool of claim 7, wherein the vacuum tube is attached to the spindle clamp body, and wherein a vacuum channel defined in the vacuum tube is in fluid communication with the vacuum cavity.

9. The clean and purge tool of claim 8, wherein the spindle clamp assembly further comprises a compression spring disposed between the spindle clamp body and the vacuum tube, the compression spring configured to apply a restorative force to at least one of the spindle clamp body and the vacuum tube for restoring an original displacement between the spindle clamp body and the vacuum tube.

10. The clean and purge tool of claim 8, wherein the spindle clamp assembly further comprises:

a vacuum fitting mounted to an exhaust port of the vacuum cavity and configured to couple the vacuum source to the exhaust port of the vacuum cavity; and a compressed gas fitting mounted to an intake port of the air purge nozzle and configured to couple the compressed gas source to the intake port of the air purge nozzle.

11. The clean and purge tool of claim 8, further comprising a filter configured to be placed between the vacuum cavity and the vacuum source to capture the particles evacuated from the media clamp.

12. The clean and purge tool of claim 1, wherein an exhaust port of the air purge nozzle is oriented toward a screw head on the media clamp.

13. A clean and purge tool comprising:

a main body;

a nest assembly rotatably attached to the main body and configured to stow an open hard disk drive, the nest assembly configured to rotate up to 180 degrees from an upward facing position to a downward facing position to dislodge particles from a media clamp of the hard disk drive when the hard disk drive is stowed in the nest assembly;

a cover hingedly attached to the nest assembly and configured to enclose the hard disk drive when the hard disk drive is stowed in the nest assembly; and a spindle clamp assembly mounted on the cover, the spindle clamp assembly comprising:

a spindle clamp body attached to the cover and having a vacuum cavity defined therein, the spindle clamp body configured to couple the vacuum cavity to a vacuum source;

a vacuum tube attached to the spindle clamp body and extending through a hole in the cover, the vacuum tube configured to encapsulate the media clamp when the cover encloses the hard disk drive, the vacuum tube having a vacuum channel defined therein, the vacuum channel in fluid communication with the vacuum cavity; and an air purge nozzle extending into the vacuum tube, wherein an exhaust port of the air purge nozzle is oriented toward a screw head on the media clamp, wherein the spindle clamp body is configured to couple the air purge nozzle to a compressed gas source, wherein the clean and purge tool is configured to dislodge particles from the media clamp when pulses of compressed gas are applied to the media clamp by the compressed gas source via the air purge nozzle and to evacuate the particles from the vacuum tube when a vacuum is applied to the vacuum cavity and the vacuum channel by the vacuum source.

* * * * *